United States Patent [19]

Rogers et al.

[11] Patent Number: 5,050,353

[45] Date of Patent: Sep. 24, 1991

[54] FOLDABLE, MULTI-LEVEL STAGING AND SEATING SUPPORT

[75] Inventors: Orley D. Rogers, Farwell; Kenneth E. Staten; Calvin K. Randall, both of Clare, all of Mich.

[73] Assignee: Stageright Corporation, Clare, Mich.

[21] Appl. No.: 549,098

[22] Filed: Jul. 6, 1990

[51] Int. Cl.[5] ..... E04H 3/12

[52] U.S. Cl. ..... 52/8; 52/67; 52/118; 52/79.5; 52/645

[58] Field of Search ..... 52/65, 67, 109, 118, 52/127.6, 127.8, 7, 9, 69, 79.5, 79.9, 8, 645, 646

[56] References Cited

U.S. PATENT DOCUMENTS

| | | | |
|---|---|---|---|
| 3,364,637 | 1/1968 | Lurra, Jr. | 52/67 X |
| 3,792,557 | 2/1974 | Pitts | 52/65 |
| 4,611,439 | 9/1986 | Graham, Jr. | 52/9 |
| 4,829,726 | 5/1989 | de Potter d'Indoye | 52/69 X |
| 4,912,887 | 4/1990 | Sullivan | 52/646 X |

*Primary Examiner*—David A. Scherbel
*Assistant Examiner*—Creighton Smith
*Attorney, Agent, or Firm*—Barnes, Kisselle, Raisch, Choate, Whittemore & Hulbert

[57] ABSTRACT

A staging and seating understructure which provides a base frame for a multiplicity of support panels. The base frame consists of a series of vertical cross frames, usually having different levels, each cross frame being connected to another cross frame by collapsible gates at each end which fold inwardly to allow movement of the cross frames close toward each other wherein the entire base frame assembly may be stored compactly.

5 Claims, 2 Drawing Sheets

FOLDABLE, MULTI-LEVEL STAGING AND SEATING SUPPORT

FIELD OF INVENTION

Foldable staging and seating supports for occasional use in auditoriums, social halls and gymnasiums.

BACKGROUND AND FEATURES OF THE INVENTION

Many auditoriums and gymnasiums in schools, and social halls in churches, cannot allot space for permanent staging or bleachers to accommodate singing groups where multi-level staging is required, or to accommodate spectators when special events such as concerts or sporting events are scheduled. To meet this demand for staging, various suppliers have merchandised collapsible or demountable support frames for staging platforms or seating. Examples of collapsible bleacher systems are found in U.S. Pat. No. 3,995,832 (Dec. 7, 1976) and U.S. Pat. No. 4,363,197 (Dec. 14, 1982). Staging support apparatus is illustrated in U.S. Pat. No. 4,638,604 (Jan. 27, 1987) assigned to the assignor of the present application.

It is an object of the present invention to provide a collapsible support frame structure which can occupy very little space in the collapsed state but which can be easily advanced for supporting staging or seating panels.

It is a further object to provide a support frame which can be handled by unskilled persons with no need for special tools in assembly or disassembly. Another object is the provision of a support structure which can be used in horizontal multiples by bridging between structures, thus reducing the need for, and cost of, individual supports for all adjacent horizontal tiers. The components which require manual lifting preferably shall weigh not more than 130 pounds and shall be adaptable to use of guard railings, chair rails, skirting enclosures and so forth. Suitable leveling devices can be readily adapted to the system.

Briefly, the invention comprises a series of multilevel frames forming an understructure, each with common vertical supports, and side gates for each level, between said frames, which pivot on the vertical supports and fold toward each other in the collapsed state. Horizontal lateral spacers stabilize the side gates. A series of support panels are each engaged at two opposed corners with vertical supports and at the remaining corners with brackets on the gates adjacent vertical supports so that each level is securely stabilized against shifting. The support panels are reinforced flat structures which can be used with either side up and optional surfaces as desired.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
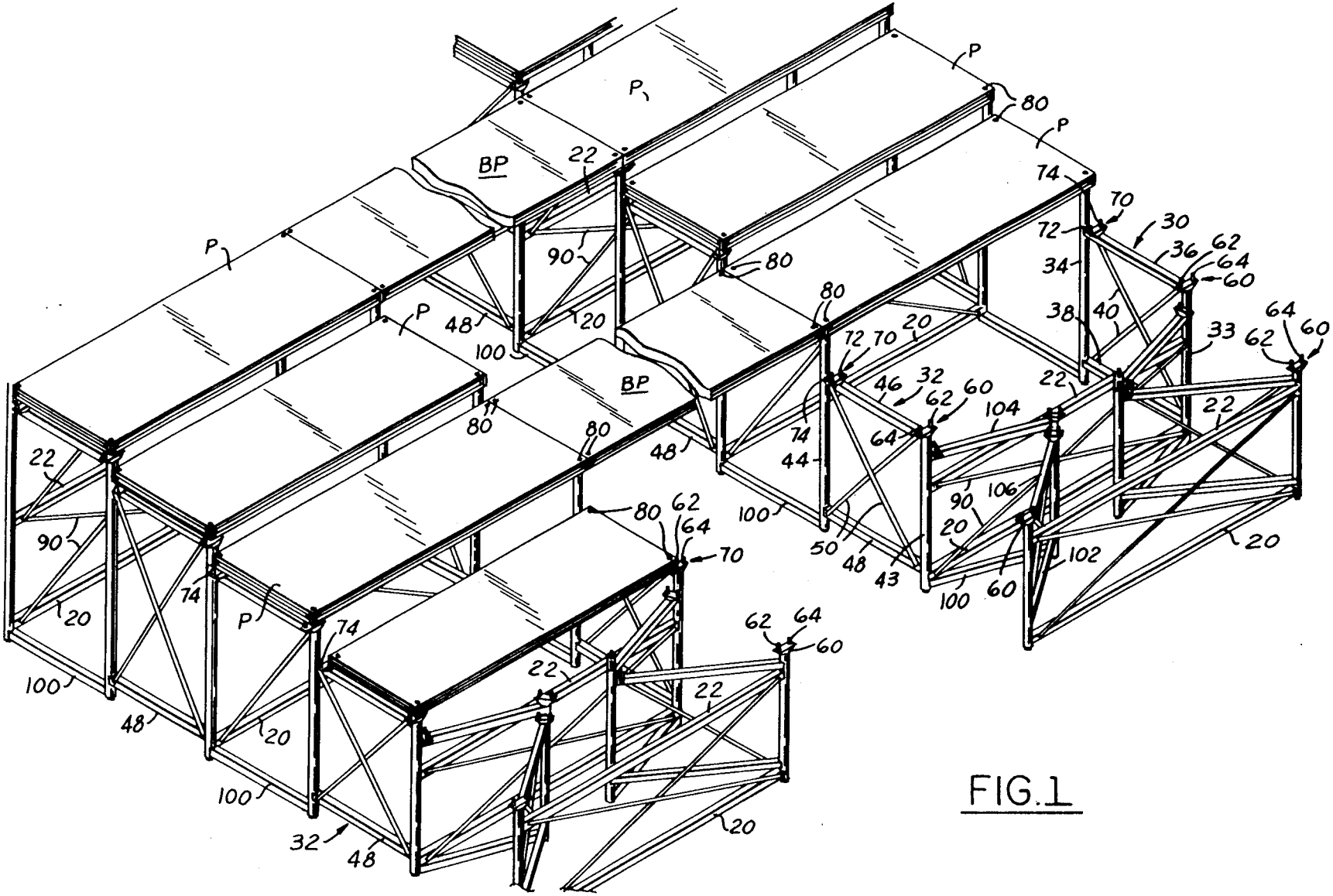
FIG. 1, a perspective view of a double collapsible frame with bridging panels.

With reference to FIG. 1, a series of staging levels are illustrated. Each panel P is supported on four vertical columns, each column being formed preferably of steel tubing dimensioned, for example, of 2.00" diameter, 11 to 14 gauge. The columns are connected laterally at the base by horizontal braces 20. Additional horizontal braces 22 at a higher level are also provided.

Each panel P is supported by a short and a long vertical column. In FIG. 1, two opposed side frames or gates 30 and 32 are shown. Gate frame 30 is formed by a vertical column 33 at the forward end and by a rearward column 34. These columns are connected by horizontal braces 36 at the top and 38 at the bottom. Cross struts 40 extend from the corners of gate frame 30. Similarly, the gate frame 32 is formed by a forward vertical column 43, a rearward column 44, top and bottom braces 46 and 48 and, cross-struts 50.

At the top of each forward vertical column is a capital plate 60 which has two spaced stub posts 62 and 64. At the rear of each top brace 36 and 46 close to the columns 34 and 44 are similar plates 70 with spaced stub posts 72 and 74. The posts 62 and 72 are inside posts which register with and receive sockets 80 in the stage panels P. The posts 64 and 74 are outside posts which will be received in the corner sockets 80 at each end of bridging panels BP as illustrated in FIG. 1. Thus, the bridging panels are supported at each end by the folding structures.

Lateral cross braces may also be utilized to provide lateral stability to the structure. These are illustrated at 90 in FIG. 1.

Figure 4:
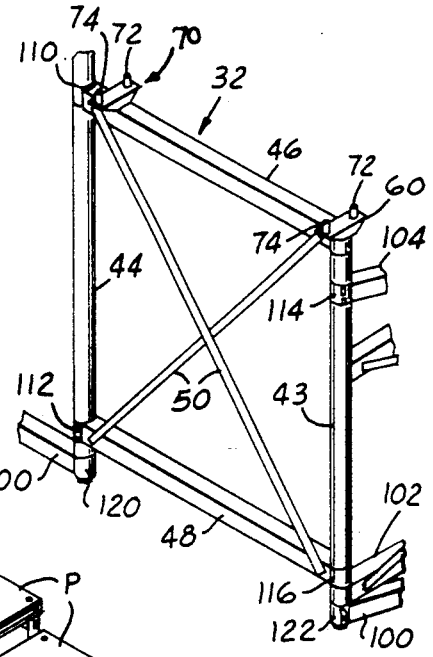
FIG. 4, a view of one gate frame illustrating the pivotal joints to permit the folding action.

In FIG. 4, an isolated view of frame gate 32 is shown for the purpose of illustrating how the frame gates are pivotally associated with the vertical columns. Pivotal sleeve collars 110 and 112 connect top and bottom braces 46 and 48, respectively, with the vertical column 44. Pivotal sleeve collars 114 and 116 connect braces 104 and 100, respectively, to column 43. At the base of column 44 is a sleeve collar 120 connected to the lower brace 100 of the next higher tier. At the base of column 43 is a sleeve collar 122 connected to the lower brace 100 of the next lower tier. These pivotal sleeve collars are not illustrated in FIGS. 1, 2 and 3 in order to simplify the graphic presentation.

Figure 2:
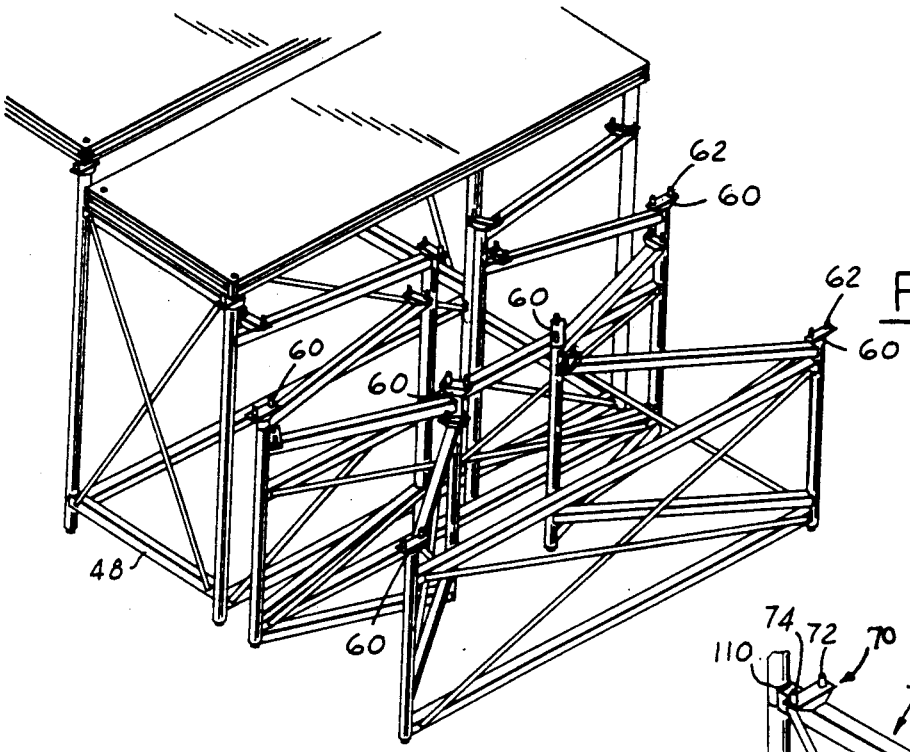
FIG. 2, a perspective view of one assembled section and multiple lower sections partially collapsed to illustrate the pivot connection.
Figure 3:
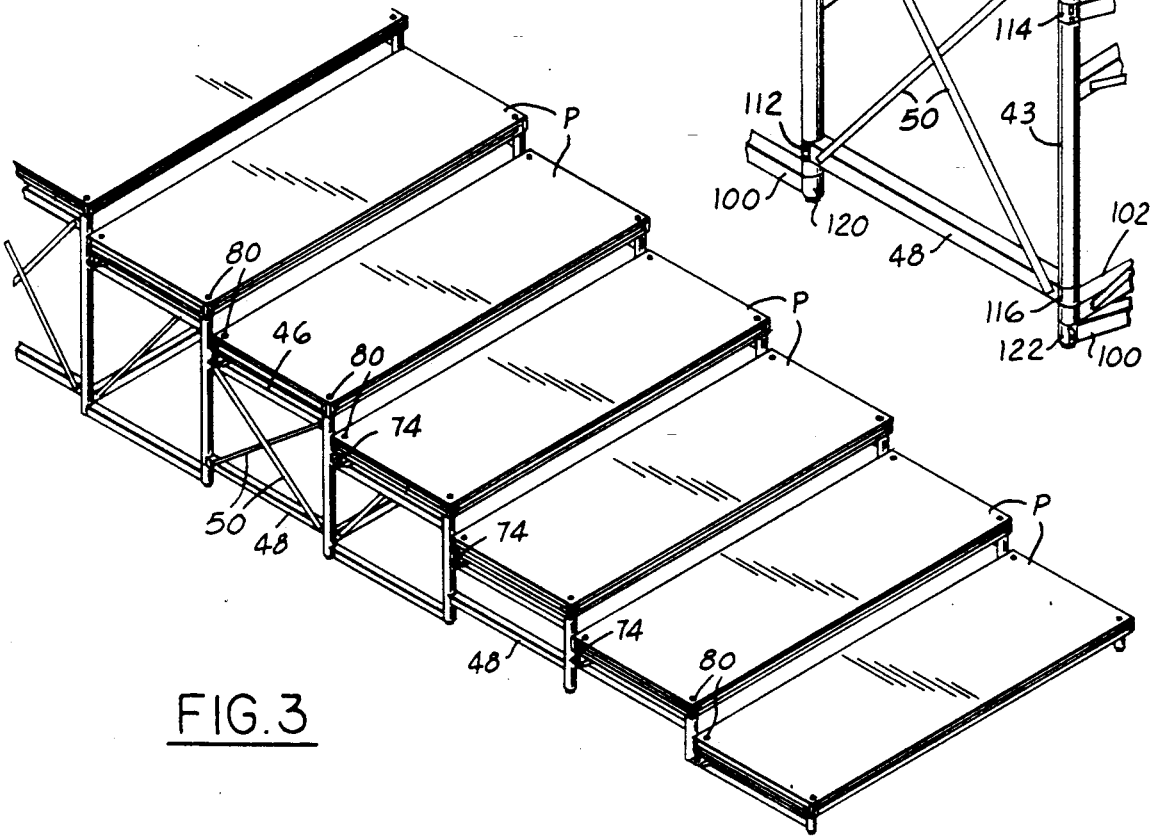
FIG. 3, a perspective view of a multi-level stage assembly in various levels from low to high.
Figure 2:
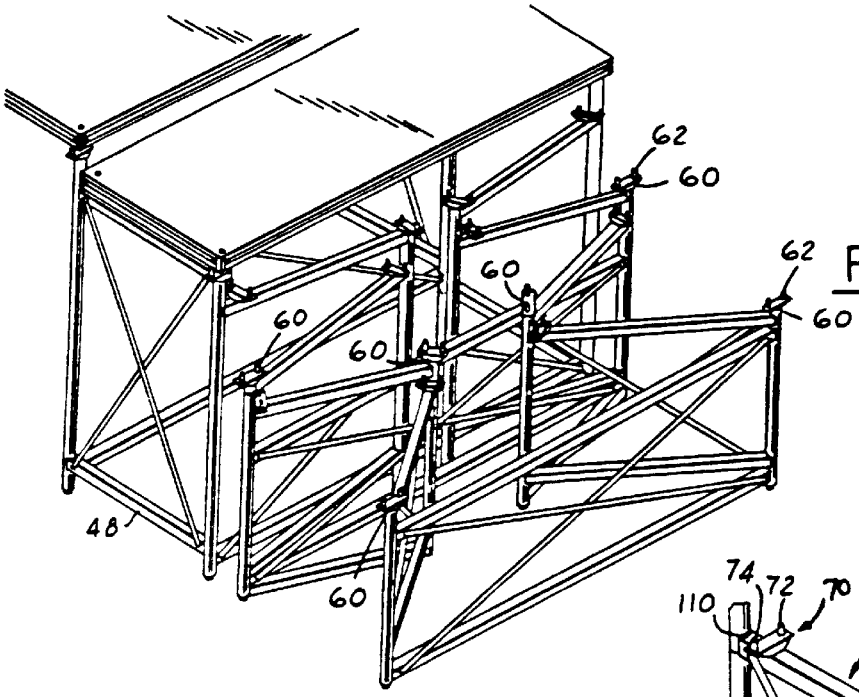
Figure 3:
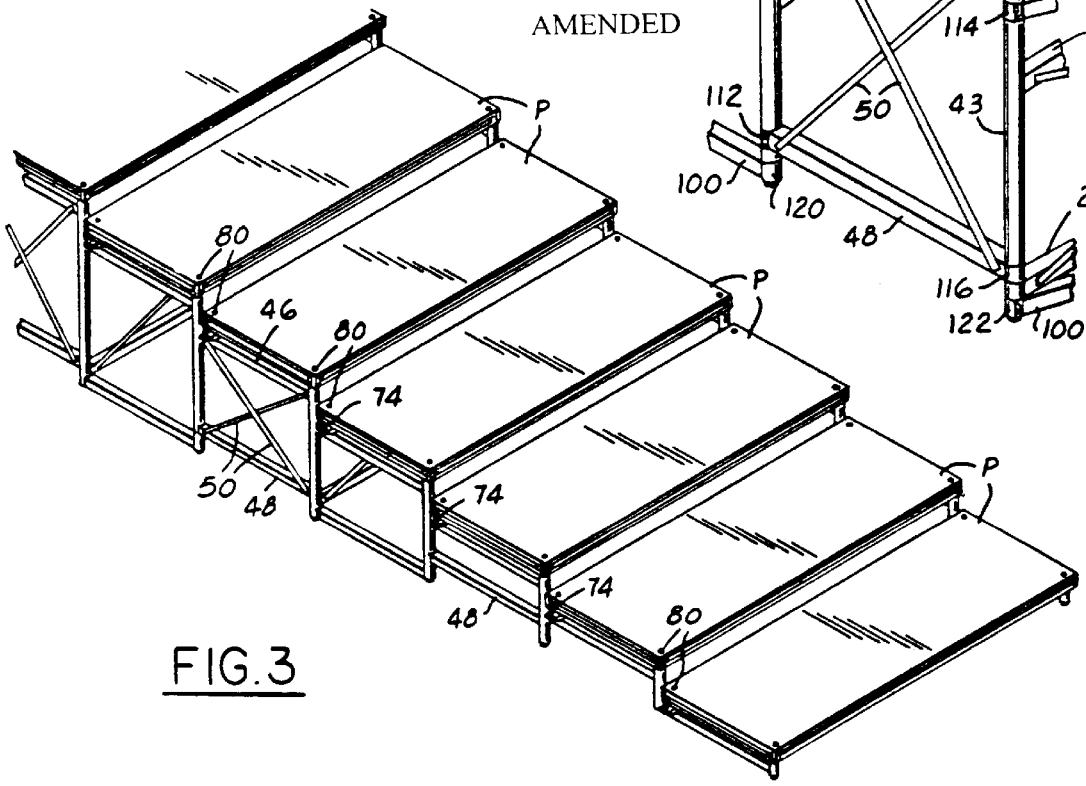

When the frames are fully extended, the gate frames 30,32 are all aligned in a vertical plane and the columns, both long and short, lie in that plane. When the panels P are all applied to and seated on the inside posts 62 and 72, the structure will be exceedingly stable. When the panels P are removed, the gate frames, some of which are shown partially folded in FIG. 1, can be completely folded in. The different levels of the cross-braces on the gate frames permit the collapsing of the gate frames into close proximity. For example, in FIG. 1, the bottom cross brace 100 is lower than the cross brace 102 in the adjacent gate frame. Similarly, the top cross brace 104 is higher than the top cross brace 106 of the same adjacent gate frame. Thus, each gate frame, as shown in FIG. 2, can fold closely adjacent the next higher gate frame and the whole structure can be folded back against a wall or moved to a storage area.

Suitable leveling screw feet on the bottom of the vertical columns can be used if needed. Also, guard railings and chair rails will be applied as needed. The dimension of the panels from front-to-back and the gate frames can be varied to provide staging levels or seating levels as needed.

It will be seen that the assembly can be adapted to as many levels as needed for a particular installation. When the system is to be activated, the various cross frames are pulled out to unfold the frame gates until all are extended. Then the support panels are applied to the upstanding stub posts to rigidify the entire assembly. The folding understructure is preferably equipped with casters to enable movement into place without lifting.

Essentially, the foldable understructure is comprised of a plurality of rigid cross frames varying in height from front to rear, each having a vertical column at each end, and a plurality of pairs of collapsible side frame gates pivotally connected at outer ends to respective vertical columns of said cross frames, and pivoted at inner ends to a displaceable vertical column which is movable by the collapsing of said gates to a storage position, and movable in an open position of said gates to align with the respective vertical columns at the ends of said cross frames.

What is claimed as new is:

1. A staging and seating understructure assembly, foldable for storage and extendable for use, which comprises:

(a) a series of vertical lateral cross frames, each with a vertical column at each end, (b) a pair of side frame gates at each end of said lateral cross frames connected between respective vertical columns at the respective ends of said lateral cross frames, (c) each side frame gate of said pairs having an inner end and an outer end, the outer ends being pivotally connected to respective vertical columns of the respective ends of said lateral cross frames, and the inner ends being pivotally connected to each other and to an inwardly displaceable vertical column at said inner ends, (d) said side frame gates being collapsible to lie adjacent and between said lateral cross frames when said understructure is collapsed, and said gates being extendible outwardly to lie in a plane between vertical columns and to position said displaceable vertical column on said plane.

2. A staging and seat understructure assembly as defined in claim 1 in combination with a series of support panels positioned horizontally on said frames and gates, and means on the top of each vertical column to interengage with a corner of a support panel to rigidify the entire assembly.

3. A staging and seating understructure assembly and panel combination as defined in claim 2 in which said means comprises upstanding stub posts on said columns, and recesses formed in the corners of said panels to receive said stub posts.

4. A staging and seating understructure assembly and panel combination as defined in claim 2 in which said means comprises a capital plate on each said vertical column, an upstanding stub post on said each capital plate, and recesses formed on the corners of said panels to receive said stub posts.

5. A staging and seating understructure assembly and panel combination as defined in claim 2 in which said means comprises a capital plate on each said vertical column, each said capital plate having two parallel upstanding stub posts spaced laterally including an inside post for engaging a recess in a panel on said understructure and an outside post for engaging bridging panels between understructures spaced apart the length of said bridging panels.

* * * * *

UNITED STATES PATENT AND TRADEMARK OFFICE

CERTIFICATE OF CORRECTION

PATENT NO. : 5,050,353 C1
DATED : May 1, 2001
INVENTOR(S) : Orley D. Rogers et al.

It is certified that error appears in the above-identified patent and that said Letters Patent is hereby corrected as shown below:

Column 1,
Line 21, delete "200.00"" insert therefor -- 2.00" --;
Line 36, delete "171 by]" insert therefor -- [by] --;
Line 38, before "horizontal" insert -- the --;
Line 64, delete "]that" insert therefor -- [that --.

Column 2,
Line 26, before "cross" insert -- lateral --.

Signed and Sealed this

Twenty-seventh Day of November, 2001

*Attest:*

Nicholas P. Godici

NICHOLAS P. GODICI

*Attesting Officer*

*Acting Director of the United States Patent and Trademark Office*

US005050353C1

(12) REEXAMINATION CERTIFICATE (4323rd)

United States Patent

Rogers et al.

(10) Number: US 5,050,353 C1

(45) Certificate Issued: May 1, 2001

(54) FOLDABLE, MULTI-LEVEL STAGING AND SEATING SUPPORT

(75) Inventors: Orley D. Rogers, Farwell; Kenneth E. Staten; Calvin K. Randall, both of Clare, all of MI (US)

(73) Assignee: Stageright Corporation, Clare, MI (US)

Reexamination Request:
No. 90/005,365, May 24, 1999

Reexamination Certificate for:

| | |
|---|---|
| Patent No.: | **5,050,353** |
| Issued: | **Sep. 24, 1991** |
| Appl. No.: | **07/549,098** |
| Filed: | **Jul. 6, 1990** |

(51) Int. Cl.[7] ..... E04H 3/12

(52) U.S. Cl. ..... 52/8; 52/67; 52/79.5; 52/118; 52/645

(58) Field of Search ..... 52/7, 8, 9, 263, 52/65, 71, 127.6, 79.5, 645, 646, 650.3

(56) References Cited

U.S. PATENT DOCUMENTS

| | | |
|---|---|---|
| 169,471 | 11/1875 | Parker . |
| 3,091,816 | 6/1963 | Wetzel . |
| 3,364,637 | 1/1968 | Curra, Jr. . |
| 3,792,557 | 2/1974 | Pitts . |
| 3,995,832 | 12/1976 | Wiese . |
| 4,363,197 | 12/1982 | Aurit . |
| 4,580,776 | 4/1986 | Burkinshaw . |
| 4,611,439 | 9/1986 | Graham, Jr. . |
| 4,638,604 | 1/1987 | Rogers et al. . |
| 4,829,726 | 5/1989 | de Potter d'Indoye . |
| 4,843,792 | 7/1989 | Rogers et al. . |
| 4,845,915 | 7/1989 | Rogers et al. . |
| 4,912,887 | 4/1990 | Sullivan . |
| 4,917,217 | 4/1990 | Rogers et al. . |

FOREIGN PATENT DOCUMENTS

| | | |
|---|---|---|
| 547147 | 3/1984 | (AU) . |
| 435440 | 10/1926 | (DE) . |
| 2418319 | 2/1978 | (FR) . |
| 700260 | 11/1953 | (GB) . |

*Primary Examiner*—Christopher T. Kent

(57) ABSTRACT

A staging and seating understructure which provides a base frame for a multiplicity of support panels. The base frame consists of a series of vertical cross frames, usually havng different levels, each cross frame being connected to another cross frame by collapsible gates at each end which fold inwardly to allow movement of the cross frames close toward each other wherein the entire base frame assembly may be stored compactly.

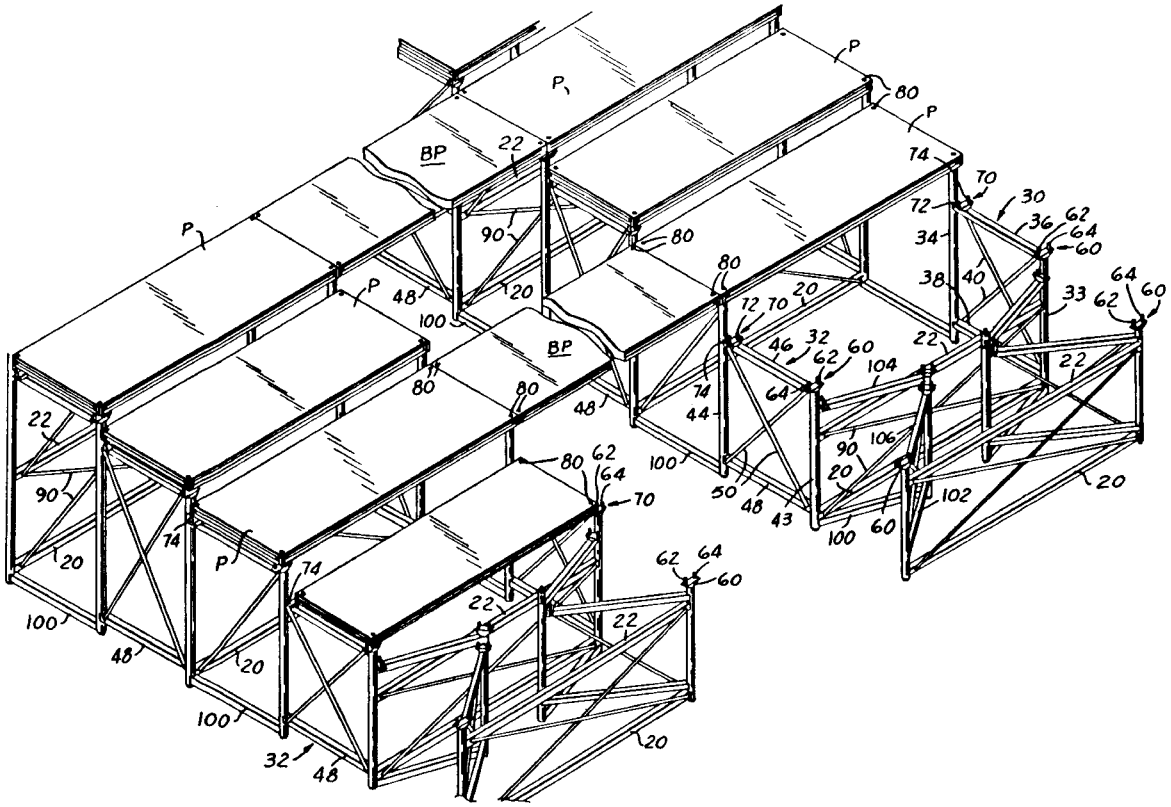

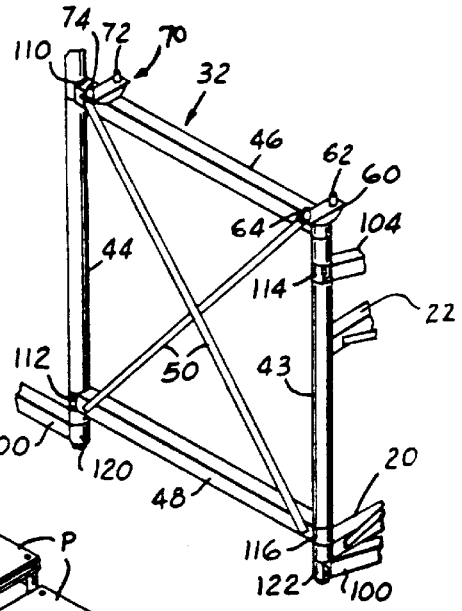
FIG. 4
AMENDED

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been delected and is no longer a part of the patent; matter printed in italics indicates additions made ot the patent.

ONLY THOSE PARAGRAPHS OF THE SPECIFICATION AFFECTED BY AMENDMENT ARE PRINTED HEREIN.

Column 2, lines 5–11:

With reference fo FIG. 1, a series of staging levels are illustrated. Each panel P is supported [on] *by* four vertical columns, each column being formed preferably of steel tubing dimensioned, for example, of 200.00" diameter, 11 to 14 gauge. [The] *Every other pair of laterally opposed* columns [are] *is* connected laterally at the base by *a* horizontal [braces] *brace* 20. [Additional] *An additional* horizontal [braces] *brace* 22 at a higher level [are] also *is* provided.

Column 2, lines 12–21:

Each panel P is supported by a [short] *forward pair of relatively shorter vertical columns* and a [long] *rearward pair of relatively longer* vertical [column] *columns*. In FIG. 1, two opposed side frames, *otherwise known as frame gates, gate frames* or *simply* gates 30 and 32 are shown. Gate frame 30 is formed [by] *between* a vertical column 33 at the forward end and 171 by] a rearward *vertical* column 34. These columns are connected by horizontal braces 36 at the top and 38 at the bottom. Cross struts 40 extend from *adjacent* the corners of gate frame 30. Similarly, the gate frame 32 is formed [by] *between* a forward vertical column 43[,] *and* a rearward column 44, *connected by* top and bottom braces 46 and 48 and, cross-struts 50.

Column 2, lines 36–48:

In FIG. 4, an isolated view of frame gate 32 is shown for the purpose of illustrating how the frame gates are pivotally associated with the vertical columns. Pivotal sleeve collars 110 and 112 connect top and bottom braces 46 and 48, respectively, with the vertical column 44. Pivotal sleeve collars 114 and 116 connect braces 104 and [100] *48*, respectively, to column 43. At the base of column 44 is a sleeve collar 120 connected to the lower brace 100 of the next higher tier. At the base of column 43 is a sleeve collar 122 connected to the lower brace 100 of the next lower tier. These pivotal sleeve collars are not illustrated in FIGS. 1, 2 and 3 in order to simplify the graphic presentation.

Column 2, lines 49–65:

When the frames are fully extended, the gate frames 30,32 are all aligned in [a] *laterally spaced apart* vertical [plane] *planes* and the columns, both long and short, lie in ]that plane] *those planes*. When the panels P are all applied to and seated on the inside posts 62 and 72, the structure will be exceedingly stable. When the panels P are removed, the gate frames, some of which are shown partially folded in FIG. 1, can be completely folded in. The different levels of the cross-braces on the gate frames permit the collapsing of the gate frames into close proximity. For example, in FIG. 1, the bottom cross brace 100 is lower than the cross brace 102 in the adjacent gate frame. Similarly, the top cross brace 104 is higher than the top cross brace 106 of the same adjacent gate frame. Thus, each gate frame, as shown in FIG. 2, can fold closely adjacent the next higher gate frame and the whole structure can be folded back against a wall or moved to a storage area.

AS A RESULT OF REEXAMINATION, IT HAS BEEN DETERMINED THAT:

The patentability of claims 2–5 is confirmed.

Claim 1 is cancelled.

New claims 6–11 are added and determined to be patentable.

*6. A staging and seating understructure and panel assembly, foldable for storage and extendable for use, which comprises:*

(*a*) *a series of vertical cross frames, each with a vertical column at each end,*

(*b*) *a pair of side frame gates at each end of said lateral cross frames connected between respective vertical columns at the respective ends of said lateral cross frames,*

(*c*) *each side frame gate of said pairs having an inner end and an outer end, the outer ends being pivotally connected to respective vertical columns of the respective ends of said lateral cross frames, and the inner ends being pivotally connected to each other and to an inwardly displaceable vertical column at said inner ends,*

(*d*) *said side frame gates being collapsible to lie adjacent and between said lateral cross frames when said understructure is collapsed, and said gates being extendible outwardly to lie in a plane between vertical columns and to position said displaceable vertical column on said plane, and*

(*e*) *a series of support panels positioned horizontally on said frames and gates.*

*7. A staging and seating understructure assembly and panel combination as defined in claim 6 further comprising upstanding stub posts on said columns, and recesses formed in the corners of said panels to receive said stub posts.*

*8. A staging and seating understructure assembly and panel combination as defined in claim 6 further comprising a capital plate on each said vertical column, an upstanding stub post on said each capital plate, and recesses formed on the corners of said panels to receive said stub posts.*

*9. A staging and seating understructure assembly and panel combination as defined in claim 6 further comprising a capital plate on each said vertical column. each said capital plate having two parallel upstanding stub posts spaced laterally including an inside post for engaging a recess in a panel on said unerstructure and an outside post for engaging bridging panels between understructures spaced apart the length of said bridging panels.*

*10. A staging and seating understructure and panel assembly, foldable for storage and extendable for use, which comprises:*

(*a*) *a series of vertical lateral cross frames, each with a vertical column at each end,*

(*b*) *a pair of side frame gates at each end of said lateral cross frames connected between respective vertical columns at the respective ends of said lateral cross frames,*

(*c*) *each side frame gate of said pairs having an inner end and an outer end, the outer ends being pivotally connected to respective vertical columns of the respective ends of said lateral cross frames, and the inner ends being pivotally connected to each other and to an inwardly displaceable vertical column at said inner ends,*

(*d*) *said side frame gates being collapsible to lie adjacent and between said lateral cross frames when said understructure is collapsed, and said gates being extendible outwardly to lie in a plane between vertical columns and to position said displaceable vertical column on said plane,*

(*e*) *a plurality of upstanding stub posts on each vertical column and on each displaceable vertical column, and*

(*f*) *said panels having recesses formed proximate the corners of said panels to engage said stub posts and maintain said displaceable vertical columns on said plane when said understructure is extended for use.*

*11. The staging and seating understructure and panel assembly of claim 10 in which said stub posts on said each vertical column and on said each displaceable vertical column are spaced laterally and include at least one inner stub post for engaging a recess in a panel on said understructure and at least one outside post for engaging a recess in a bridging panel between understructures spaced apart substantially the length of said bridging panel.*

* * * * *

US005050353C2

(12) EX PARTE REEXAMINATION CERTIFICATE (5381st)

United States Patent

Rogers et al.

(10) Number: US 5,050,353 C2

(45) Certificate Issued: May 23, 2006

(54) FOLDABLE, MULTI-LEVEL STAGING AND SEATING SUPPORT

(75) Inventors: Orley D. Rogers, Farwell, MI (US); Kenneth E. Staten, Clare, MI (US); Calvin K. Randall, Clare, MI (US)

(73) Assignee: Stageright Corporation, Clare, MI (US)

Reexamination Request:
No. 90/006,508, Jan. 6, 2003

Reexamination Certificate for:

| | |
|---|---|
| Patent No.: | **5,050,353** |
| Issued: | **Sep. 24, 1991** |
| Appl. No.: | **07/549,098** |
| Filed: | **Jul. 6, 1990** |

Reexamination Certificate C1 5,050,353 issued May 1, 2001

Certificate of Correction issued Nov. 27, 2001.

(51) Int. Cl.
*E04H 3/12* (2006.01)

(52) U.S. Cl. ..... 52/8; 52/67; 52/79.5; 52/118; 52/645

(58) Field of Classification Search ..... 52/7–9, 52/65, 67, 71, 79.5, 79.9, 109, 118, 127.6, 52/127.8, 263, 645, 646, 650.3
See application file for complete search history.

(56) References Cited

U.S. PATENT DOCUMENTS

| | | | | |
|---|---|---|---|---|
| 97,605 A | | 12/1869 | Cleeton | |
| 279,134 A | | 6/1883 | Comins | |
| 308,656 A | * | 12/1884 | Du Bois | 52/9 |
| 795,957 A | | 8/1905 | Cartland | |
| 1,675,375 A | | 7/1928 | Netschert | |
| 1,943,871 A | | 1/1934 | Landberg | |
| 2,057,334 A | | 10/1936 | Hannum | |
| 2,536,357 A | | 1/1951 | David | |
| 2,553,579 A | | 5/1951 | Harris | |
| 2,781,527 A | | 2/1957 | Landry | |
| 2,890,089 A | | 6/1959 | Sanchez | |
| 3,091,816 A | * | 6/1963 | Wetzel | 108/172 |
| 4,534,447 A | | 8/1985 | Champigny | |
| 4,580,776 A | | 4/1986 | Burkinshaw | |
| 4,609,071 A | | 9/1986 | Edwards | |
| 4,638,604 A | | 1/1987 | Rogers et al. | |
| 4,974,526 A | | 12/1990 | Wiygul, Jr. | |

FOREIGN PATENT DOCUMENTS

| | | |
|---|---|---|
| DE | 435440 | 10/1926 |
| FR | 461672 | 11/1913 |
| FR | 1383126 | 11/1964 |
| GB | 690 | of 1890 |
| GB | 221080 | 9/1924 |

* cited by examiner

*Primary Examiner*—Winnie Yip

(57) ABSTRACT

A staging and seating understructure which provides a base frame for a multiplicity of support panels. The base frame consists of a series of vertical cross frames, usually havng different levels, each cross frame being connected to another cross frame by collapsible gates at each end which fold inwardly to allow movement of the cross frames close toward each other wherein the entire base frame assembly may be stored compactly.

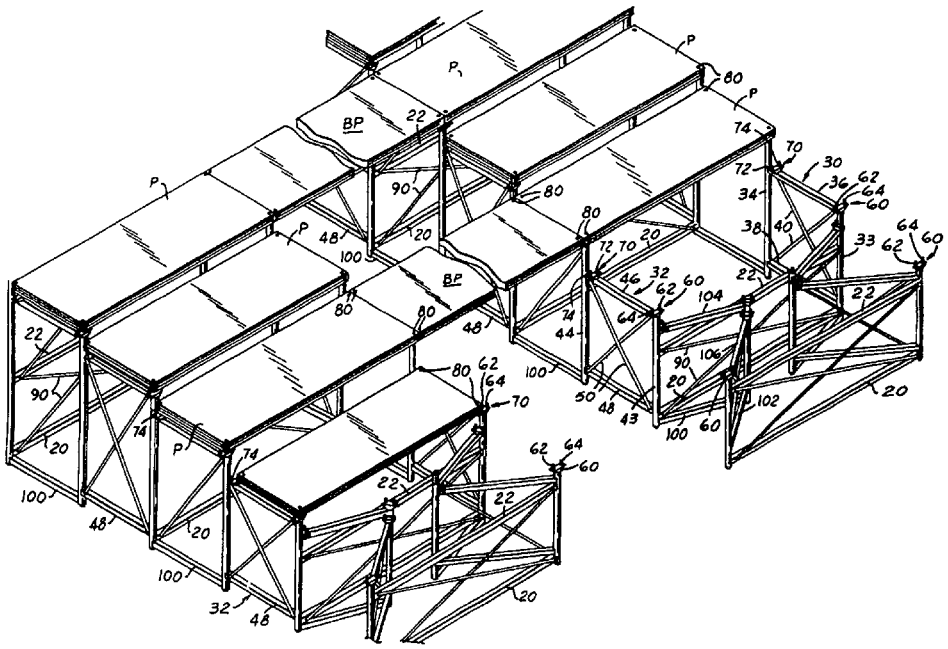

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–4, 7, 8 and 9 is confirmed.

Claim 1 was previously cancelled.

Claims 2 and 6 are cancelled.

Claims 5, 10 and 11 are determined to be patentable as amended.

5. A staging and seating understructure assembly and panel combination as defined in claim 2 in which said means comprises a capital plate on each said vertical column, each said capital plate having two parallel upstanding stub posts spaced laterally including an inside post for engaging a recess in [a] *said* panel on said understructure *assembly* and an outside post for engaging *a* bridging panel[s] between understructure[s] *assemblies* spaced apart the length of said bridging panel[s].

10. A staging and seating understructure and panel assembly, foldable for storage and extendable for use, which comprises:

(a) a series of vertical lateral cross frames, each with a vertical column at each end, (b) a pair of side frame gates at each end of said lateral cross frames connected between respective vertical columns at the respective ends of said lateral cross frames, (c) each side frame gate of said pairs having an inner end and an outer end, the outer ends being pivotally connected to respective vertical columns of the respective ends of said lateral cross frames, and the inner ends being pivotally connected to each other and to an inwardly displaceable vertical column at said inner ends, (d) said side frame gates being collapsible to lie adjacent and between said lateral cross frames when said understructure is collapsed, and said gates being extendible outwardly to lie in a plane between vertical columns and to position said displaceable vertical column on said plane, (e) a plurality of upstanding stub posts on each vertical column and on each displaceable vertical column, [and]

(f) *a series of support panels positioned horizontally on said frames and gates, and*

(*g*) said panels having recesses formed proximate the corners of said panels to engage said stub posts and maintain said displaceable vertical columns on said plane when said understructure is extended for use.

11. The staging and seating understructure and panel assembly of claim 10 in which said stub posts on said each vertical column and on said each displaceable vertical column are spaced laterally and include at least one inner stub post for engaging a recess in [a] *said* panel on said understructure and at least one outside post for engaging a recess in a bridging panel between understructures spaced apart substantially the length of said bridging panel.

* * * * *